United States Patent [19]

Ives

[11] Patent Number: 4,582,275

[45] Date of Patent: Apr. 15, 1986

[54] COLLAPSIBLE MANDREL

[76] Inventor: Frank Ives, 1862 Ives Ave., Kent, Wash. 98031

[21] Appl. No.: 606,620

[22] Filed: May 3, 1984

[51] Int. Cl.[4] ..... B65H 75/24

[52] U.S. Cl. ..... 242/110; 242/72 R; 242/115; 249/179; 425/471; 425/DIG. 14

[58] Field of Search ..... 242/110, 110.1, 110.2, 242/110.3, 72 R, 68.2, 53, 115; 249/179; 269/48.1; 425/471, DIG. 14

[56] References Cited

U.S. PATENT DOCUMENTS

| | | | |
|---|---|---|---|
| 905,305 | 12/1908 | Gage | 242/72 X |
| 977,222 | 11/1910 | Roberts | 242/72 X |
| 1,000,261 | 8/1911 | Hansen | 242/72 |
| 1,040,536 | 10/1912 | Hansen | 242/72 |
| 1,093,284 | 4/1914 | Mehlum | 242/72 |
| 2,557,631 | 6/1951 | Callan | 25/123 |
| 2,623,259 | 12/1952 | Schuh, Sr. | 25/124 |
| 2,973,160 | 2/1961 | Zernov | 242/72 |
| 3,164,877 | 1/1965 | Lee | 249/179 |
| 3,911,965 | 10/1975 | Wiltshire et al. | 138/178 |
| 3,918,659 | 11/1975 | Padgett, Jr. | 242/53 |
| 4,012,266 | 3/1977 | Magee et al. | 156/173 |
| 4,153,232 | 5/1979 | Burchett | 249/179 X |
| 4,233,020 | 11/1980 | Oswald | 425/471 |

FOREIGN PATENT DOCUMENTS

| | | | |
|---|---|---|---|
| 163532 | 6/1958 | Switzerland | 249/179 |

*Primary Examiner*—John M. Jillions

*Attorney, Agent, or Firm*—Christensen, O'Connor, Johnson & Kindness

[57] ABSTRACT

A collapsible, cantilevered mandrel is disclosed comprising a core rotatable about a longitudinal axis, a tubular shell having a longitudinal slit to permit collapsing of the shell, means for rigidly mounting an arcuate segment of the shell to the core such that the shell is disposed about the longitudinal axis, and means for collapsing the mandrel. The means for collapsing the mandrel includes an actuating member mounted between the core and the shell for reciprocal motion, and a plurality of linkage means connected to the actuating member. Each linkage means is connected to first and second portions of the shell on opposite sides of the slit, and is adapted to cause at least one of the first and second portions to move circumferentially towards the other portion and radially inward when the actuating member moves.

8 Claims, 7 Drawing Figures

COLLAPSIBLE MANDREL

BACKGROUND OF THE INVENTION

A mandrel is a rotatable, cylindrical apparatus upon which fiberglass and related materials can be wound to produce pipes, cylindrical tanks and similar articles. After the fiberglass hardens, the article is removed from the mandrel by sliding it in a longitudinal direction parallel to the mandrel axis. Because the hardened article is in close contact with the mandrel over a considerable surface area, the removal of the article can be a difficult process. One known expedient is to provide means for collapsing or reducing the diameter of the mandrel after the article hardens. By collapsing the mandrel, the contact between the article and the mandrel is broken, and the article can then be removed in a longitudinal direction.

A further technique to facilitate removal of articles is to support the mandrel in a cantilevered manner with one end unobstructed, so that hardened articles can be removed over the unobstructed end without disassembly of the support apparatus. However, the length of mandrel that can be cantilevered is limited by the mandrel's weight, and the mandrel's weight is, in turn, dependent upon the complexity of the internal mechanism, if any, for reducing the mandrel diameter. Although designs for collapsible mandrels have been proposed, none of the prior designs has resulted in a collapsible mandrel that is sufficiently light in weight to permit the effective use of a cantilevered support for the larger mandrel sizes.

SUMMARY OF THE INVENTION

The present invention provides a novel collapsible mandrel that is adapted for the cantilevered mounting of both large and small mandrel sizes. The mandrel of the present invention comprises a core rotatable about a longitudinal axis, a tubular shell having a longitudinal slit, and means for mounting an arcuate segment of the shell to the core such that the shell is disposed about the longitudinal axis. The mandrel also includes actuating means and a plurality of linkage means for collapsing the mandrel. The actuating means includes an actuating member mounted between the core and the shell for reciprocal motion. Each linkage means is connected to the actuating member and to first and second portion of the shell. The first portion of the shell is that portion on one side of the slit and the second portion of the shell is that portion on the opposite side of the slit. Each linkage means is adapted to cause at least one of the first and second portions to move circumferentially towards the other portion when the actuating member moves, thereby collapsing the mandrel.

In a preferred embodiment, the second portion of the shell is rigidly mounted with respect to the core, and each linkage means is adapted to cause the first portion of the shell to move both circumferentially towards the second portion of the shell and radially inward when the actuating member moves. The actuating means may comprise a source of reciprocal motion, a first actuating member connected to the source, a lever arm connected to the first actuating member, and a second actuating member connected to the lever arm such that the first and second actuating members move in concert. Such actuating means also comprises a plurality of first toggle linkages connected to the first actuating member and at least one second toggle linkage connected to the second actuating member.

These and other features of the invention will become apparent in the detailed description and claims to follow taken in conjunction with the accompanying drawings.

DETAILED DESCRIPTION OF THE DRAWINGS

Figure 1:
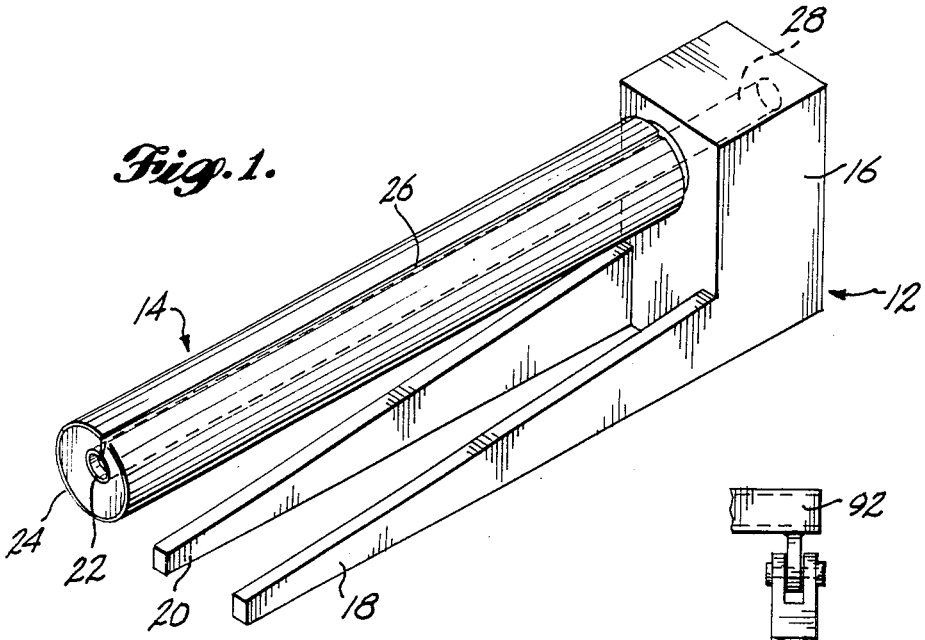
FIG. 1 is a perspective view of a collapsible mandrel according to the present invention.

Referring initially to FIG. 1, one preferred embodiment of the present invention comprises a base 12 and cylindrical mandrel 14 rotatable about its longitudinal axis. Base 12 includes drive housing 16 and legs 18 and 20 extending from the drive housing in a direction parallel to the axis of mandrel 14. The mandrel includes inner core 22 and outer shell 24. Shell 24 is supported on core 22, in a manner described below, and core 22 is, in turn, supported on axle 28 mounted in and cantilevered from drive housing 16. Shell 24 includes longitudinal slit 26 extending the full length of the shell. As described below, slit 26 allows the diameter of mandrel 14 to be reduced to facilitate the removal of an article which has hardened on the mandrel. Drive housing 16 includes conventional means (not shown) for mounting axle 28 in a cantilevered manner such that the axle is free to rotate.

Figure 2:
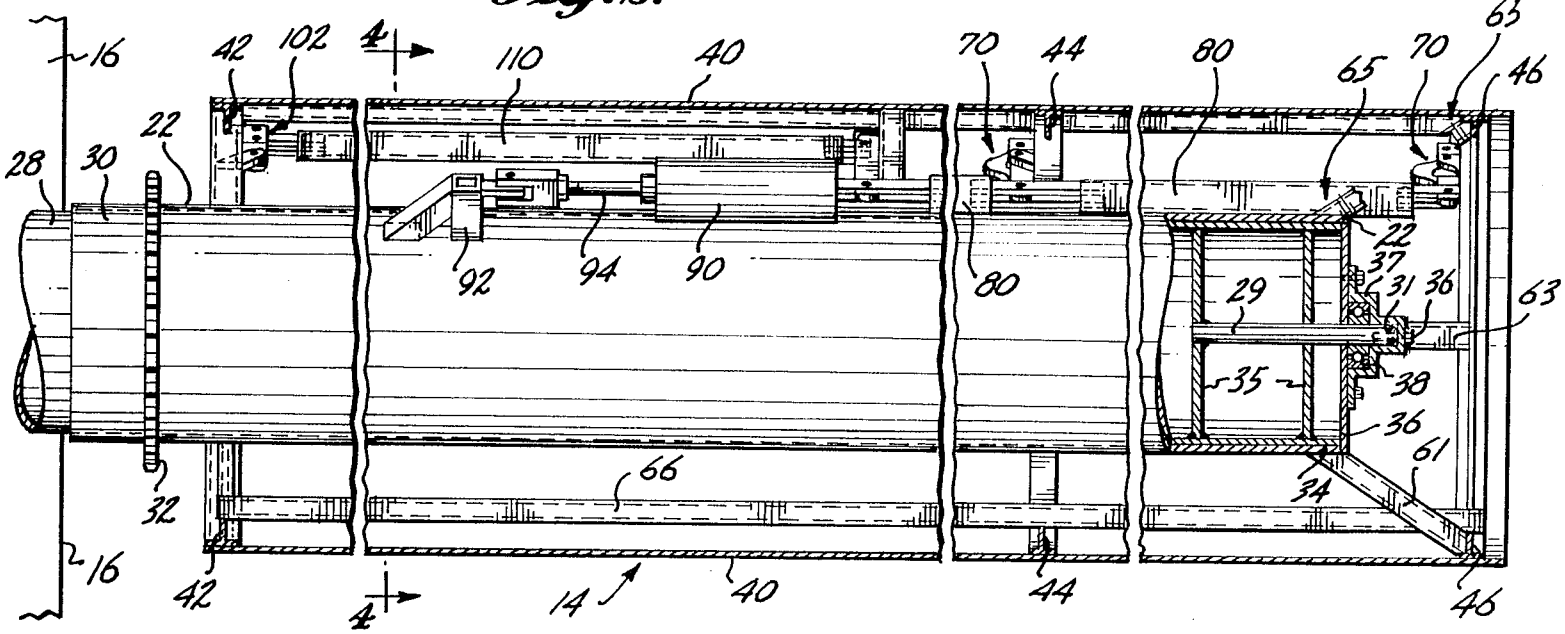
FIG. 2 is a side elevational view of the collapsible mandrel with portions broken away.

Referring now to FIG. 2, core 22 is tubular in form and extends longitudinally for essentially the full length of the mandrel. The core includes a first end 30 that projects a short distance from one end of mandrel 14 towards drive housing 16, and that has sprocket 32 mounted thereon. Sprocket 32 is used to connect the core to means (not shown) for rotating the core and mandrel 14. The second end 34 of core 22 includes radial plate 36 to which housing 37 and bearing 38 are mounted. Axle 28 extends in a cantilevered manner from drive housing 16. Axle 28 and core 22 are sized such that the core can be mounted on the axle with a close sliding fit, as indicated in FIG. 2, with the core free to rotate on the fixed axle. Rod 29 is mounted to axle 28 by radial plates 35, rod 29 including tapered end 31 that extends a short distance from the end of the axle. When the mandrel is mounted on the axle, rod 29 is engaged by bearing 38, and housing 37 is bolted to tapered end 31 of rod 29 by bolt 36, thus securing the mandrel to the axle. It will be apparent that through this arrangement, a series of mandrels having shells of different diameters can readily be used with a single base.

Referring now to FIGS. 2–5, shell 24 comprises smooth, cylindrical skin 40 and a plurality of circumferential hoops attached to the inner surface of the skin and spaced longitudinally along the axis of the mandrel, hoops 42, 44 and 46 being shown in FIG. 2. Each hoop has a T-shaped cross section. As may best be seen in FIGS. 4 and 5, skin 40 extends completely around mandrel 14 except for a small gap at slit 26. The skin along one side 50 of slit 26 includes lip 49 that angles radially inward, such that the lip extends slightly under the skin on the opposite side 52 of the slit. Each hoop, such as hoop 44 in FIGS. 4 and 5, extends most of the way about the circumference of the mandrel, but ends on either side of slit 26 to form gap 53 under the slit. Shell 24 is thus comparatively thin in the vicinity of slit 26, and the portion of the shell on side 50 of slit 26 can therefore readily be pulled and moved underneath the portion of the shell on side 52 of slit 26 to collapse the mandrel, such motion being indicated by the arrow in FIG. 5. By pulling the shell on side 50 both towards side 52 and radially inward, the diameter of the mandrel is reduced and a gap 100 is formed between the shell on side 50 and an article 10 that has hardened on the mandrel. The formation of gap 100 serves to break the vacuum that would otherwise form due to the reduction of the mandrel diameter. The mandrel can therefore be collapsed using less force and using a lighter and less complex collapsing mechanism.

Figure 5:
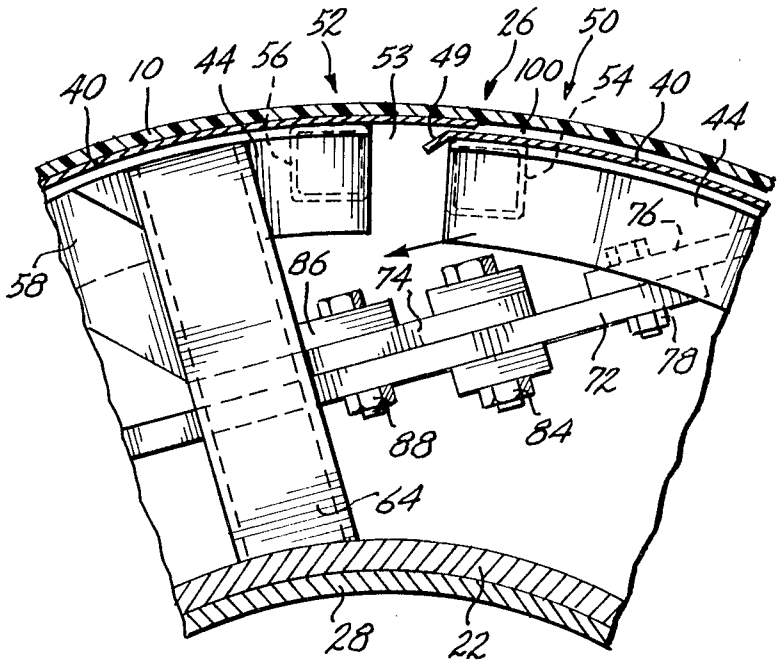
FIG. 5 is an expanded view of a portion of the cross-sectional view of FIG. 4.
Figure 4:
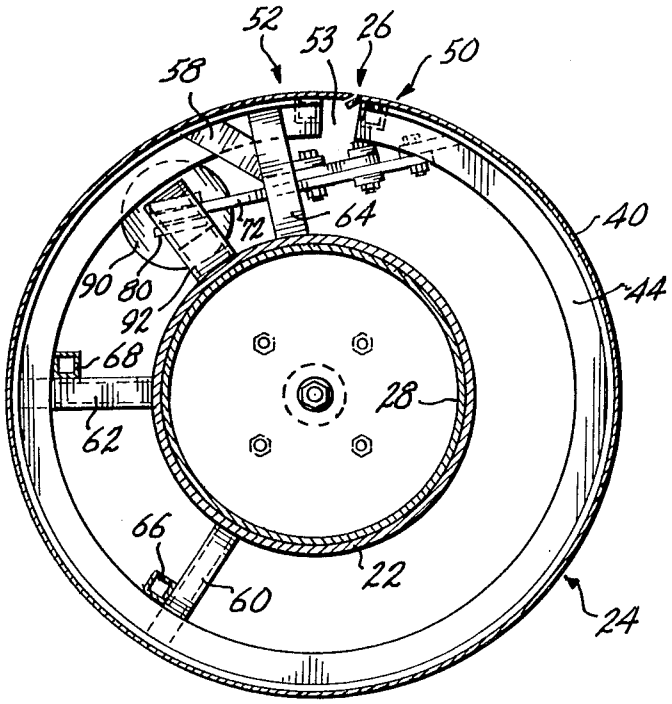
FIG. 4 is a cross-sectional view taken along line 4—4 of FIG. 2.

Skin 40 on side 50 of the slit is reinforced by beams 54 which attach directly to the underside of the skin and extend between adjacent hoops. The skin on side 52 of the slit is reinforced by beams 56 in a similar manner. Each hoop is secured to core 22 by three radial spokes extending outwardly from the core to the hoop. In FIG. 4, spokes 60, 62 and 64 are shown supporting hoop 44 over an angular segment of about 150°. The other hoops are supported by spokes over the same angular segment. Spokes 61, 63 and 65 supporting hoop 46 from end 34 of core 22 are angled in a longitudinal direction, as indicated in FIG. 2. Shell 24 as a whole is thus rigidly secured to core 22 over a 150° portion of its circumference. As can be seen in FIGS. 4 and 5, this arrangement permits the unsupported portion of shell 24, e.g., the portion of the shell on side 50 of the slit, to be pulled leftward and inward to collapse the mandrel. Longitudinal beams 66 and 68 are provided to add rigidity to the supported segment of the shell. In addition, spoke 64 and similar spokes for the other hoops are reinforced by struts, such as strut 58 for spoke 64, extending at an angle from the spoke to the corresponding hoop.

Figure 3:
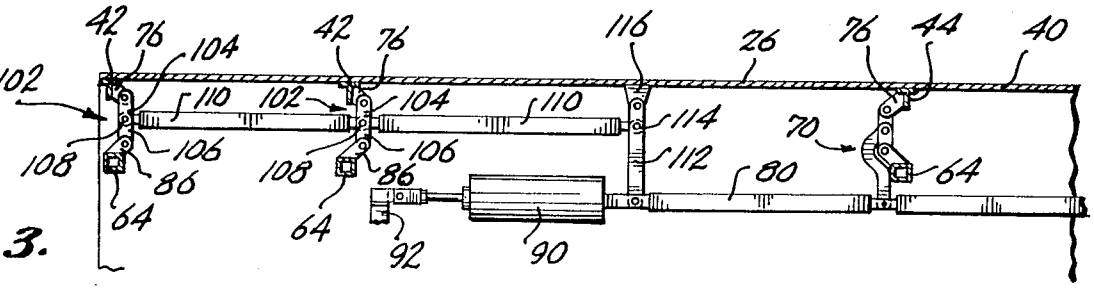
FIG. 3 is a schematic view of the actuating means for the mandrel.

Each hoop has associated with it a toggle linkage for causing the shell on side 50 of the slit to move towards the shell on side 52, and radially inward, to collapse the mandrel. Referring to FIGS. 2 and 3, the system for actuating the toggle linkages comprises air cylinder 90 mounted adjacent to core 22 by bracket 92 and turnbuckle connector 94. The movable piston assembly of air cylinder 90 is connected to actuating bar 80. Air cylinder 90 is pressurized and depressurized by pneumatic means (not shown) such that actuating bar 80 reciprocates in a longitudinal direction along the length of the mandrel. Actuating bar 80 is connected to toggle linkages 70 associated with each hoop (44, 46) positioned to the right of air cylinder 90 in FIGS. 2 and 3. Toggle linkages 70 are described below in greater detail. Actuating bar 80 is also connected to lever arm 112, and the other end of lever arm 112 is pivotally connected to flange 116 that is, in turn, secured to shell 26. Second actuating bar 110 is connected to short toggle linkages 102 associated with each hoop 42 positioned to the left of air cylinder 90 in FIGS. 2 and 3, and is also pivotally connected to lever arm 112 by pivot pin 114. Thus, motion of actuating bar 80 is coupled to actuating bar 110 by lever arm 112 and, as a result, actuating bars 80 and 110 reciprocate in concert with one another. Actuating bars 80 and 110 each includes a plurality of cylindrical segments interconnected by pairs of parallel bars between which the toggle linkages are pivotally connected.

Figure 7:
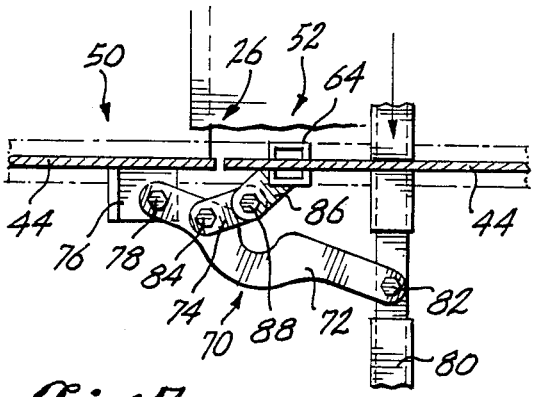
FIG. 7 is an elevational view showing the toggle linkage of FIG. 6 when the mandrel is collapsed.
Figure 6:
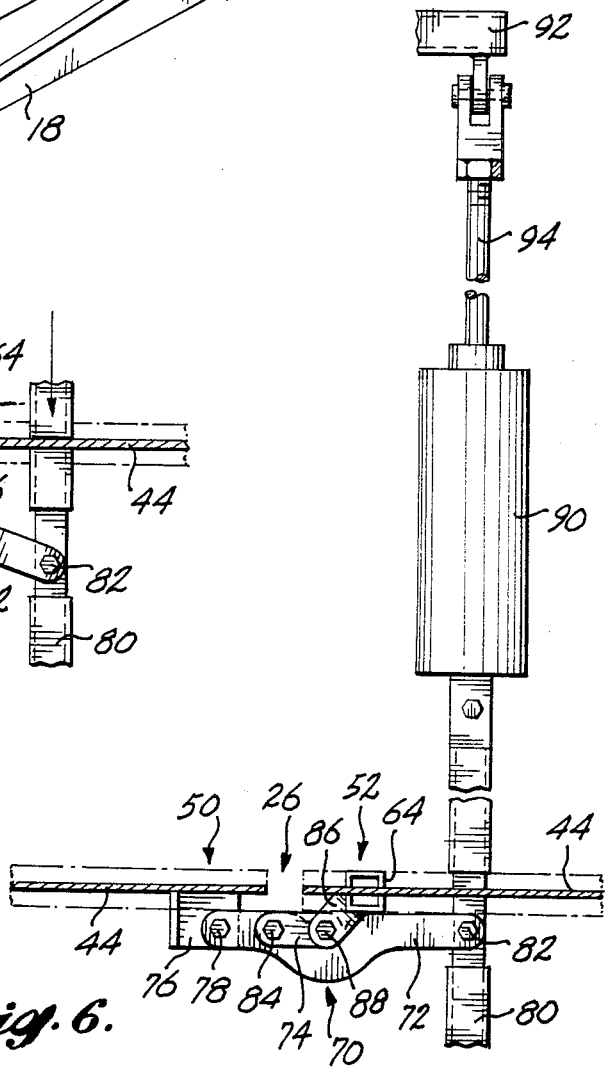
FIG. 6 is an elevational view of a portion of the actuating means, showing a toggle linkage prior to collapsing the mandrel.

FIGS. 6 and 7 show toggle linkage 70 for hoop 44 in greater detail, toggle linkages 70 for the other hoops to the right of air cylinder 90 (in FIGS. 2 and 3) being identical in construction. Toggle linkage 70 includes master link 72 and slave link 74. Master link 72 is connected to flange 76 by pivot pin 78, and flange 76 is, in turn, connected to hoop 44 adjacent side 50 of slit 26. The other end of master link 72 is connected to actuating bar 80 by pivot pin 82. One end of slave link 74 is connected to master link 72 by pivot pin 84, while the other end of slave link 74 is connected to flange 86 by pivot pin 88. Flange 86 is connected to spoke 64 which, in turn, is connected to hoop 44 adjacent side 52 of the slit.

As indicated in FIG. 3, each short toggle linkage comprises first and second arms 104 and 106 that are connected together at adjacent ends by pivot pins 108 that have their outer ends connected to flanges 76 and 86, respectively. Flanges 76 and 86 are respectively connected to hoops 42 and spokes 64 in a manner similar to that for toggle linkages 70.

The technique by which the mandrel of the present invention is collapsed is illustrated in FIGS. 3 and 5–7. FIG. 6 shows the configuration of toggle linkage 70 when the mandrel is in its uncollapsed state with air cylinder 90 not pressurized. When it is desired to collapse the mandrel, air pressure is supplied to air cylinder 90, causing actuating bar 80 to move in a downward direction, as indicated in FIG. 7. Downward movement of actuating bar 80 causes master link 72 to pivot about pivot point 78, causing pivot pin 84 to move downward with respect to pivot pins 78 and 88. Such downward motion of pivot pin 84 causes pivot pins 78 and 88 to move closer together, thereby causing side 50 of shell 26 to move towards and under side 52, as indicated in FIG. 5, reducing the diameter of the mandrel and forming gap 100 between the mandrel and article 10 formed thereon. Reciprocation of second actuating bar 110 actuates shortened toggle linkages 102 in a conventional manner, causing the side 50 of shell 26 to move towards and under side 52 in a manner similar to that for toggle linkages 70. The article may then be slid of the unsupported end of the mandrel. When air pressure is cut off from air cylinder 90, the toggle linkages return to their relaxed states, toggle linkages 70 returning to the configuration shown in FIG. 6.

While the preferred embodiments of the invention have been illustrated and described, it should be understood that variations will be apparent to those skilled in the art. Accordingly, the invention is not to be limited to the specific embodiments illustrated and described, and the true scope and spirit of the invention are to be determined by reference to the appended claims.

The embodiments of the invention in which an exclusive property or privilege is claimed are defined as follows:

1. A collapsible mandrel comprising:

a core having a longitudinal axis;

means for rotating the core about the longitudinal axis;

a tubular shell having a longitudinal slit to permit collapsing of the shell;

means for rigidly mounting an arcuate segment of the shell to the core such that the shell is disposed about the longitudinal axis;

actuating means including an actuating member mounted between the core and the shell for reciprocal motion; and a plurality of linkage means connected to the actuating member, each linkage means being connected to first and second portions of the shell, the first portion being that portion of the shell on one side of the slit and the second portion being that portion of the shell on the opposite side of the slit, each linkage means being adapted to pull and move the first portion of the shell in a direction both circumferentially towards the second portion of the shell and radially inward when the actuating member moves, thereby collapsing the mandrel.

2. The mandrel of claim 1, wherein the arcuate segment of the shell includes the second portion of the shell, such that the second portion of the shell is rigidly mounted with respect to the core.

3. The mandrel of claim 1, wherein each linkage means comprises a toggle linkage.

4. The mandrel of claim 3, wherein the actuating member is mounted for reciprocal motion along the longitudinal axis, and wherein each toggle linkage comprises first link means having one end pivotally connected to the first portion of the shell and a second end pivotally connected to the actuating member.

5. The mandrel of claim 4, wherein each toggle linkage further comprises second link means pivotally connected to the first link means and to the second portion of the shell.

6. The mandrel of claim 1, wherein the actuating means comprises a source of reciprocal motion, a first actuating member connected to said source, a lever arm connected to the first actuating member, a second actuating member connected to the lever arm such that the second actuating member reciprocates in concert with the first actuating member, and wherein the plurality of linkage means includes a plurality of first toggle linkages connected to the first actuating member and at least one second toggle linkage connected to the second actuating member.

7. The mandrel of claim 1, wherein the shell comprises a cylindrical skin and a plurality of circumferential hoops fastened to the inner surface of the skin at spaced apart positions along the longitudinal axis, the skin being cut in a direction parallel to the longitudinal axis to form the longitudinal slit, and each hoop including a gap underlying the slit.

8. The mandrel of claim 1, wherein the core comprises a tubular member having a central axis coincident with the longitudinal axis, and wherein the mandrel further comprises an axle upon which the tubular member is mounted, means for supporting the axle at one end thereof, and means for rotating the axle about the longitudinal axis.

* * * * *